United States Patent [19]

Hodge

[11] 4,014,457

[45] Mar. 29, 1977

[54] TRASH CONTAINER LID SYSTEM

[76] Inventor: Allan M. Hodge, 5852 Lomond Drive, San Diego, Calif. 92120

[22] Filed: May 20, 1976

[21] Appl. No.: 688,167

[52] U.S. Cl. ..... 220/331; 220/345; 220/1 T

[51] Int. Cl.[2] ..... B65D 43/14; B65D 51/04

[58] Field of Search ..... 220/1 T, 331, 335, 345, 220/346, 349

[56] References Cited

UNITED STATES PATENTS

| | | | |
|---|---|---|---|
| 3,487,887 | 1/1970 | Pensa | 220/331 |
| 3,951,302 | 4/1976 | Owen et al. | 220/331 |

*Primary Examiner*—George T. Hall

*Attorney, Agent, or Firm*—Poms, Smith, Lande & Glenny

[57] ABSTRACT

A trash container lid system for placement on top of large industrial trash bins of the type utilized in hotels, apartment houses, etc., in which a lid section is rotatably coupled to a trash bin. The lid is slidably coupled to the top surfaces of the side sections of the trash bins via slide members on the lid and a slide track, preferably nylon bearing strips, on the top edge of the side sections, and rotatably coupled to the trash bin via lever arms rotatably coupled at one end to the trash bin and at another end to a lower back portion of the lid section.

5 Claims, 14 Drawing Figures

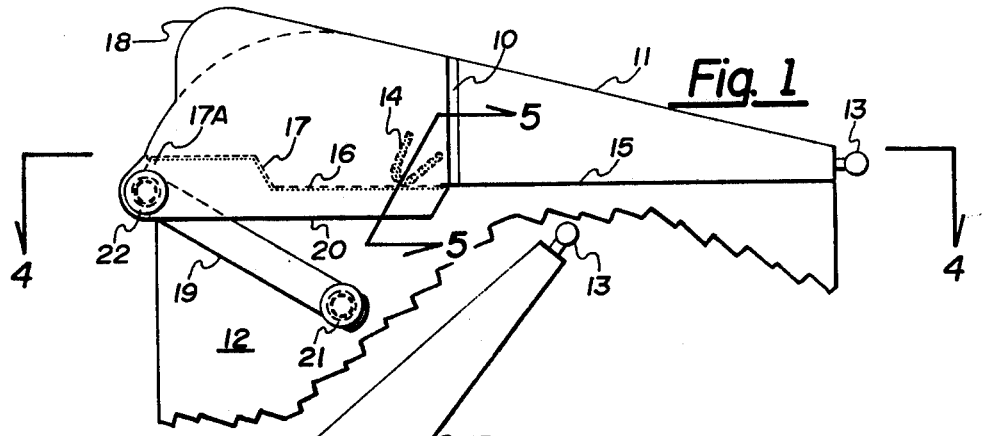
Fig. 1
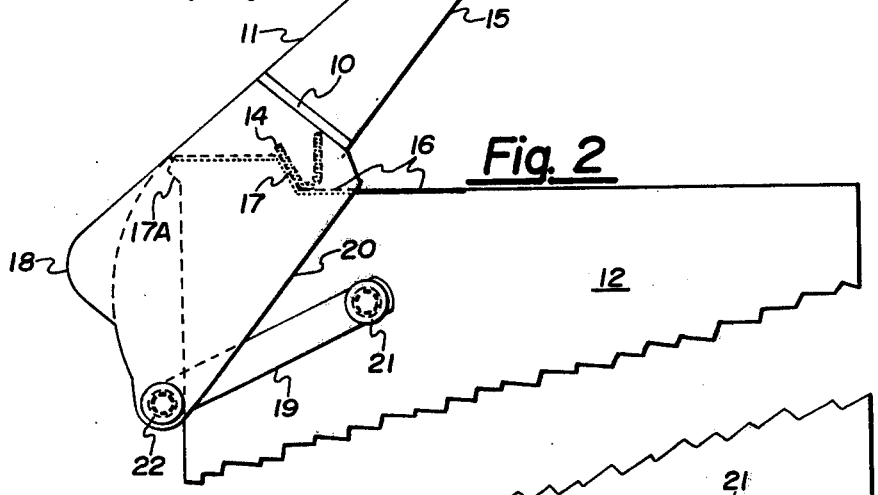
Fig. 2
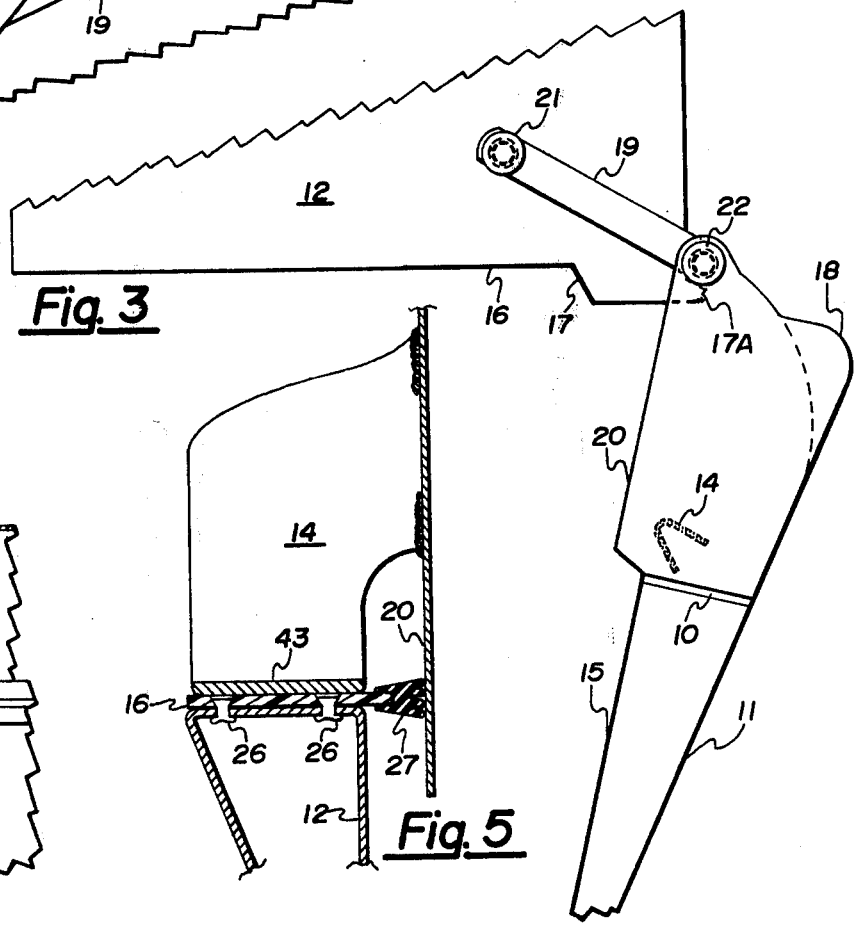
Fig. 3
Fig. 5
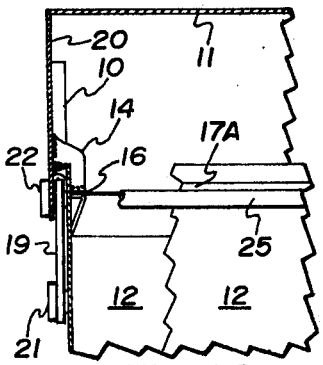
Fig. 10

TRASH CONTAINER LID SYSTEM

RELATED APPLICATIONS

An application for United States Letters Patent was filed by Allan M. Hodge and Calvin P. Owen on Aug. 5, 1974, Ser. No. 494,622, now abandoned, for a Trash Container Lid System. A continuation of that application was filed on Dec. 24, 1975, Ser. No. 644,188, now U.S. Pat. No. 3,989,162.

BACKGROUND OF THE INVENTION

The continuation application for United States Letters Patent referred to above for a trash container lid system by Allan M. Hodge, instant inventor, and Calvin P. Owen, Ser. No. 644,188, Filed Dec. 24, 1975 Now U.S. Pat. No. 3,989,162, utilizes the same basic rotatable coupling as the instant invention. It has been found emperically, however, that considerable savings in construction costs and improvement in durability is effected by utilizing the slide members and slide tracks of the instant invention as opposed to rollers and roller tracks previously utilized.

BRIEF DESCRIPTION OF THE INVENTION

The present invention relates to a trash container lid system and, more particularly, to a trash container lid system having a stabilized slidably achieved partially open position.

According to the invention, trash container lid system is provided which is coupled to a trash bin via lever arms rotatably coupled to the lid assembly at one end and rotatably coupled to the trash container at another end. The lever arms are mounted on the back areas of both the lid assembly and the trash bins so that as the lid is raised, the back portion of the lid drops, describing an arc about the point of coupling of the lever arms. In one embodiment, the lever arms are attached at the sides of the trash container and the lid section and, in another embodiment, the lever arms are attached at the backs of the trash container and the lid section.

The lid assembly is preferably counterbalanced in the back portion thereof for reducing the amount of force necessary to raise and lower the lid and for holding the lid in a partially opened position in a stabilized condition. In both embodiments, an arcuate slide member is carried in the center section of the lid assembly on each side thereof, slidably engaging the top side surfaces of the trash container, preferably constructed of a low-friction bearing material such as glass-filled nylon. Raised portions of the slide tracks result in stops for holding the lid in a partially opened position. Upon dumping the container, whereby the entire assembly is inverted over the cab of a dump truck, the lid will fall in a vertical position with the pivot arms resting against upward stop extensions at the top of the back surface of the container.

An object of the present invention is the provision of an improved trash container lid assembly.

Another object of the invention is the provision of a trash container lid assembly having a stabilized partially opened position.

A further object of the invention is the provision of an improved trash container lid assembly which is sealed against the container in a closed position.

Yet another object of the present invention is the provision of a trash container lid system which is extremely convenient in use and simple in construction.

Other objects and many of the attendant advantages of the present invention will be readily appreciated as the same becomes better understood by reference to the following detailed description when considered in connection with the accompanying drawings in which like reference numerals designate like parts throughout the Figures thereon and wherein:

FIG. 1 is a side elevational view of a preferred embodiment of the present invention in a closed position;

FIG. 2 is a side elevational view of the embodiment of FIG. 1 in a stabilized partially opened position;

FIG. 3 is a side elevational view of the embodiment of FIG. 1 in an inverted position;

FIG. 5 is a sectional view taken along lines 5 - 5 of FIG. 1;

FIG. 10 is a top view of the lid section of the embodiments of FIGS. 1 and 6;

FIG. 11 is a detail of one hinge portion of the embodiment of FIG. 6;

DETAILED DESCRIPTION OF THE DRAWINGS

Figure 6:
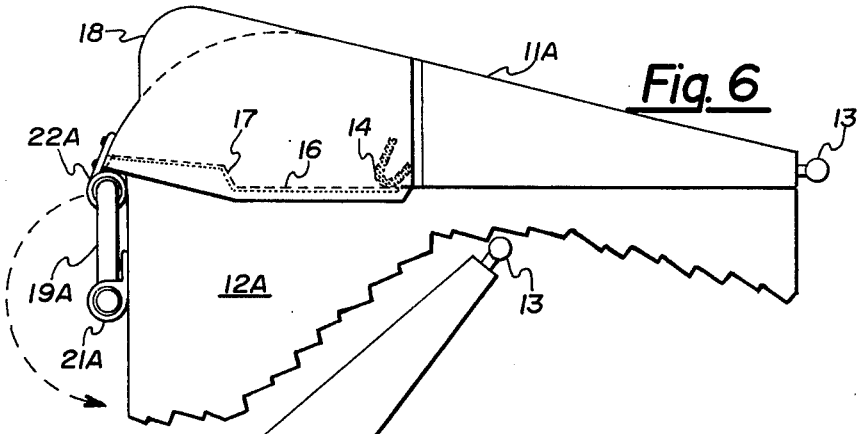
FIG. 6 is a side elevational view of another embodiment of the present invention.

Referring to FIGS. 1, 2, and 3, a trash container lid is shown generally at 11 coupled to a trash container 12. Trash container lid 11 has a handle 13 and carries a metallic slider 14 on inside surface. Slider 14 rests on slide track 16, which is preferably glass-filled nylon, and has a raised portion 17 forming a stop for slider 14. Lid section 11 terminates at a top rear portion in a counterweight 18 which can be cement filled, for example. Lever arm 19 is rotatably coupled at pivot point 21 on trash container 12 at one end thereof and is rotatably coupled at another end thereof at pivot point 22 at the lower rear portion of trash container lid 11.

Section 20 extends out beyond the top of 15 of trash bin lid 12 from a fold 10 in lid section 11. Raised section 17A forms a stop against lever arm 19 when the trash container is inverted and lid section 11 is in a fully opened position (FIG. 3). Raised portion 17 forms a stop for slide member 14 when lid 11 is in a stabilized partially opened position (FIG. 2).

Figure 4:
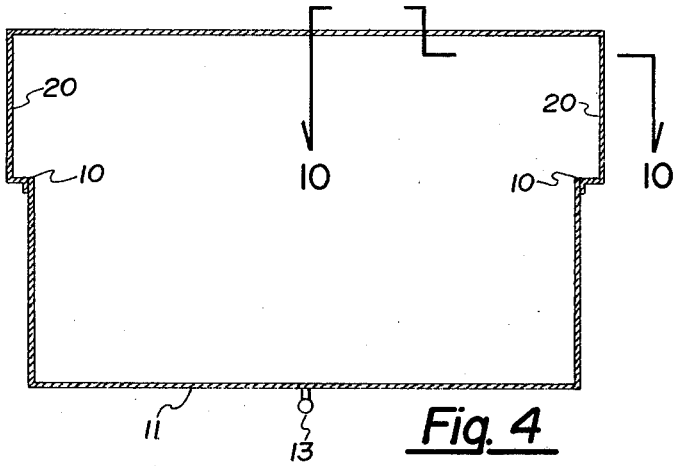
FIG. 4 is a sectional view taken along lines 4 - 4 of FIG. 1.

Referring to FIG. 4, lid section 11 has bends 10 in the sides thereof, which create expended sections 20 for overlapping trash container 12 (NOT SHOWN).

Figure 14:
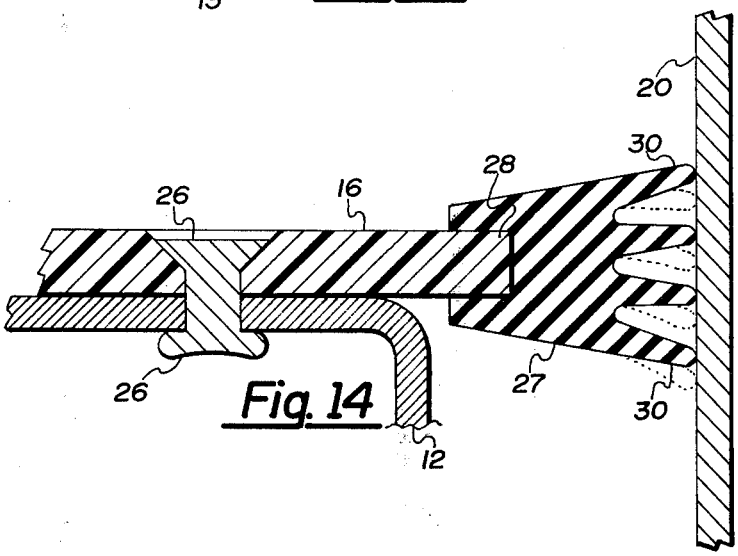
FIG. 14 is an enlarged detail of a portion of FIG. 5.

Referring to FIGS. 5 and 14, slide member 14 is attached to the inner surface of lid assembly 11 as by welding and contacts slide track 16, which is attached as by rivets 26 to the top surface of the side of container 12. Flexible seal strip 27 is carried by slide track 16 via a recess 28. Flexible seal strip 27 terminates on sealing fingers 30.

Referring to FIGS. 6, 7, 8, and 9, everything is identical to the embodiment of FIGS. 1, 2, and 3, with the exception of raised portion 17 being slightly lower and lever linkage 19A disposed in back of trash container 12A and rotatably coupled thereto via hinge bracket 21A. Bracket 22A on lid section 11A is coupled to a top rear portion instead of the side thereof and rotatably receives lever arm linkage 19A.

Figure 7:
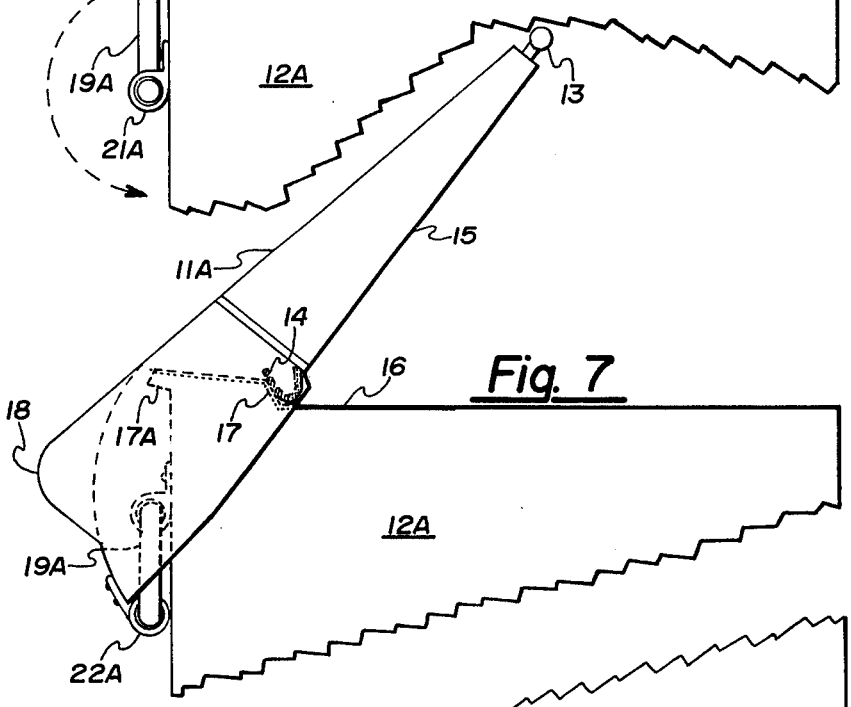
FIG. 7 is a side elevational view of the embodiment of FIG. 6 in the stabilized partially opened position.

In FIG. 7, it can be seen that when slide member 14 reaches raised portion 17 of slide track 16, lever arm linkage 19A has rotated approximately 180° and bracket 22A contacts the back surface of trash container 12A, effecting a more positive and even more stabilizing partially opened position.

Figure 8:
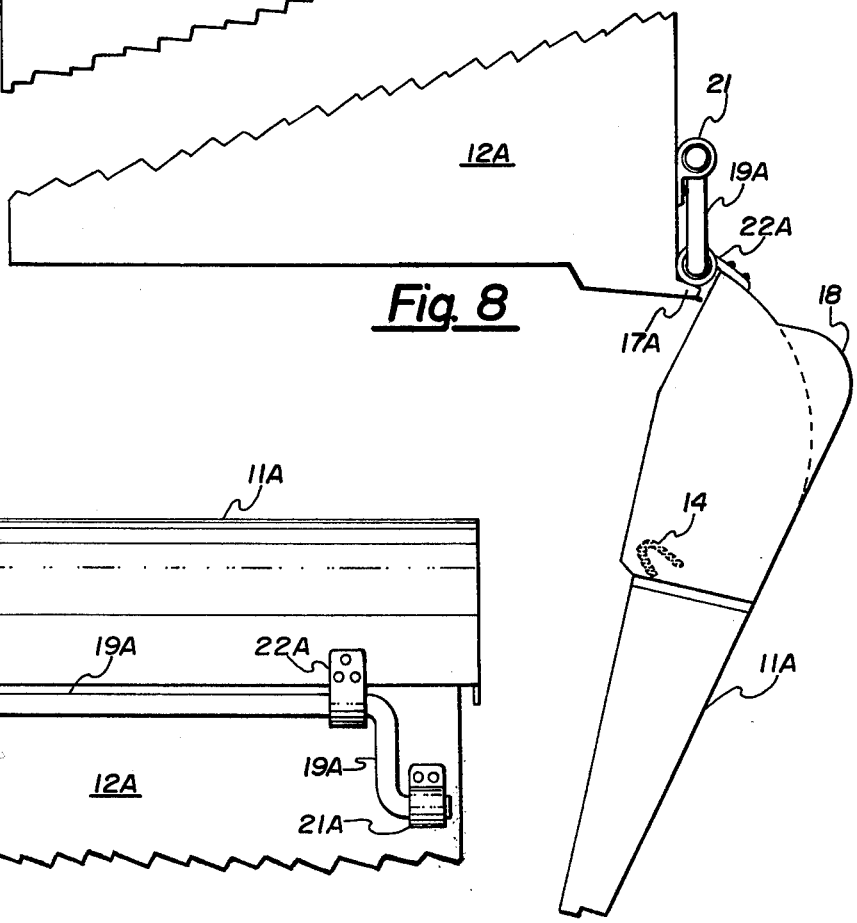
FIG. 8 is a side elevational view of the embodiment of FIG. 6 in an inverted position.

FIG. 8 illustrates lever arm linkage 19A in the same position as in FIG. 6, but with container 12A inverted for complete emptying thereof.

Figure 9:
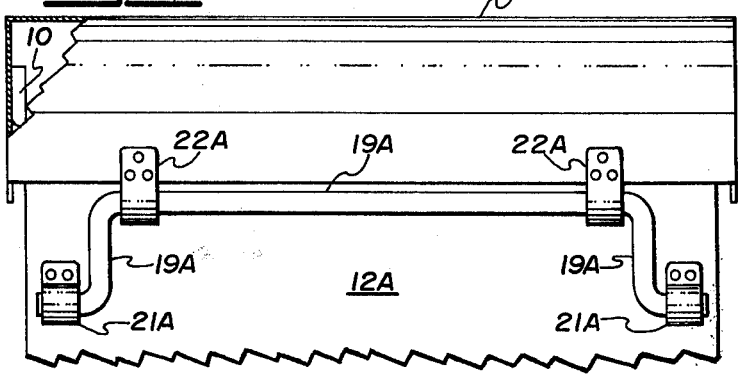
FIG. 9 is a back elevational view of the embodiment of FIG. 6.

Referring to FIG. 9, top hinge brackets 22A on the back of lid section 11A rotatably carries lever arm linkage 19A. Lever arm linkage 19A is also rotatably carried by bottom hinge brackets 21A, which are coupled to the back of trash container 12A.

Referring to FIG. 11, lever arm linkage 19A has a collar 31 which bears against thrust washer 32. Lever arm linkage 19A is received by sleeve bearing 33 press-fit within hinge bracket 22A.

Figure 12:
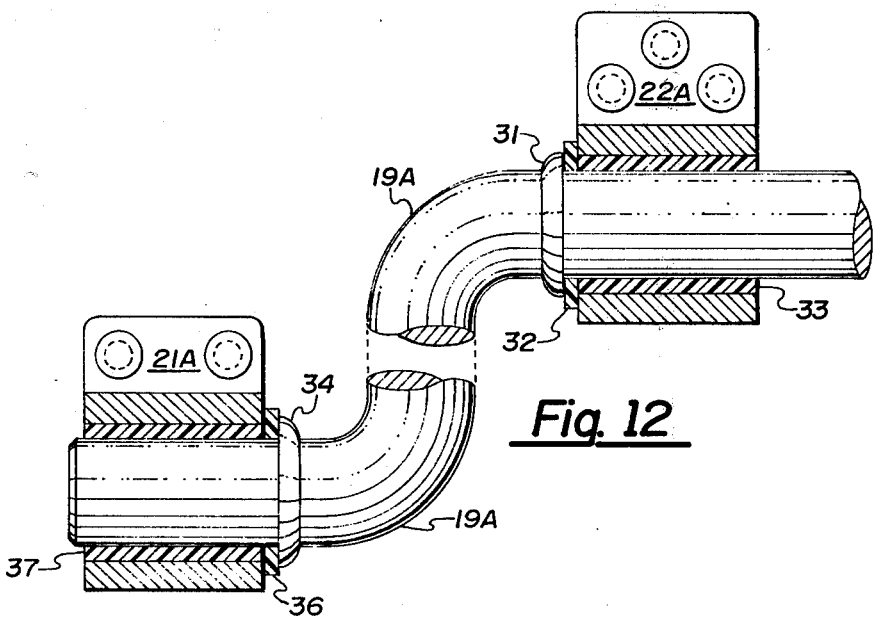
FIG. 12 is a detail of another hinge portion of the embodiment of FIG. 6.

Referring to FIG. 12, lever arm linkage 19A has an annular collar 34 which abuts thrust washer 36. Sleeve bearing 37 is carried by hinge bracket 21A and rotatably receives lever arm linkage 19A.

Figure 13:
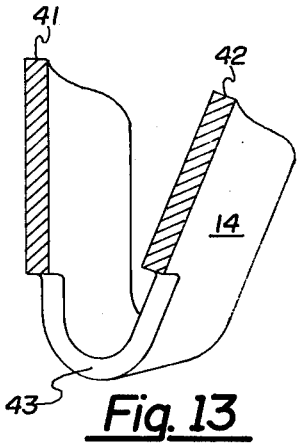
FIG. 13 is a perspective view of the slider element of the embodiments of FIGS. 1 and 6.

Referring to FIG. 13, slide member 14 has coupling surfaces 41 and 42 and an arcuate bearing section 43 therebetween.

OPERATION

Referring back to FIGS. 1, 2, 6, and 7, it can be seen that when it is desired to maintain the lid 11 and 11A in a stabilized partially opened position as shown in FIGS. 2 and 7, for emptying trash therein, the handle 13 is pushed upwardly and backwardly, which rotates lever arms 19 in the case of the embodiment of FIGS. 1 and 2, or the lever arm linkage 19A in the case of the embodiment of FIGS. 6 and 7, moving the counterweight section 18 to the rear of container 12 or 12A until slider 14 reaches raised section 17 on the nylon bearing strip 16. At this point, lid 11 or 11A is in a stabilized, partially opened position. When it is desired to close the lid from the position shown in FIGS. 2 and 7, the reverse action takes place, i.e., the user pulls forwardly and downwardly on handle 13 until counterweight section 18 is positioned over the back of container 12 or 12A and the lid seats itself on the top edges of containers 12 or 12A.

It is pointed out here that a sealing strip is preferably placed on the top forward edges of containers 12 and 12A and on the bottom forward edges of lids 11 and 11A.

Referring to FIG. 10, torque rod 25 is fixedly attached to lever arms 19 to lend stability to the lid system during opening and closing operations. In the embodiment of FIGS. 6, 7, 8, and 9, a lever arm linkage 19A has lever arm sections disposed between hinge brackets 21A and 22A and a torque rod section disposed between the two hinge brackets 22A for unitizing the actions of the two hinged sections.

Referring to FIGS. 3 and 8, when it is desired to empty containers 12 and 12A, they are inverted over the top of a truck cab allowing lid sections 11 and 11A to fall into a vertical position beneath the containers to facilitate complete emptying of the containers.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A trash container lid system for use with large industrial trash bins in which the lid is rotatably coupled to the trash bin by means of a lever arm and is slidably coupled to the trash bin by means of a roller on the lid, comprising:

a trash bin having an upper edge;

a lid section having a lower edge dimensioned for cooperation with said trash bin upper edge;

first and second lever arms, said first and second lever arms each being rotatably coupled at one end to first and second pivot points on said trash bin and rotatably coupled at their other end to third and fourth pivot points on said lid section;

first and second slide members carried by said lid section;

first and second slide tracks on the top of opposite edges of said trash bin, said first and second slide tracks slidably carrying said first and second slide members; and a raised portion at the back termination of said first and second slide tracks, to stop the rearward movement of said lid section when it is raised rearwardly for the purpose of opening said bin to receive trash; whereby said lid can remain in a stabilized partially opened position.

2. The trash container lid system of claim 1 wherein: said first and second slide members have arcuate sections contacting said first and second slide members, respectively.

3. The trash container lid system of claim 1 wherein: said first and second slide tracks comprise first and second strips of low-friction bearing material.

4. The trash container lid system of claim 1 wherein: said first and second pivot arms are coupled to opposite side portions of said trash bin and said lid section.

5. The trash container lid system of claim 1 wherein: said first and second lever arms comprise first and second linkages, each rotatably coupled to first and second hinge brackets on the back surfaces of said trash bin and lid section, respectively.

* * * * *